United States Patent [19]

Mercier

[11] Patent Number: 4,890,955

[45] Date of Patent: Jan. 2, 1990

[54] CONTROL DEVICE FOR UNDERGROUND DRAINAGE NETWORK

[75] Inventor: Francois Mercier, Montreal, Canada

[73] Assignee: Innotag Inc., Quebec, Canada

[21] Appl. No.: 313,495

[22] Filed: Feb. 22, 1989

[30] Foreign Application Priority Data

Feb. 22, 1988 [GB] United Kingdom ..... 8804009

[51] Int. Cl.[4] ..... E02B 11/00

[52] U.S. Cl. ..... 405/37; 405/36; 405/39

[58] Field of Search ..... 405/36–48, 405/52; 137/236.1; 210/170

[56] References Cited

U.S. PATENT DOCUMENTS

| | | | |
|---|---|---|---|
| 585,856 | 7/1897 | Swanson | 405/37 |
| 888,217 | 5/1908 | Bishop | 405/37 |
| 1,018,251 | 2/1912 | McKee | 405/37 |
| 2,674,490 | 4/1954 | Richards | 405/37 X |
| 3,559,408 | 2/1971 | Earnhart | 405/52 X |
| 4,538,377 | 9/1985 | Thornton | 405/39 X |
| 4,621,945 | 11/1986 | Schafer et al. | 405/37 X |

FOREIGN PATENT DOCUMENTS

| | | | |
|---|---|---|---|
| 1006596 | 3/1983 | U.S.S.R. | 405/37 |
| 1035575 | 8/1983 | U.S.S.R. | 405/37 |

*Primary Examiner*—Dennis L. Taylor

*Attorney, Agent, or Firm*—Cushman, Darby & Cushman

[57] ABSTRACT

The disclosure herein describes a control device for use with an underground drainage network of main collectors and adjacently disposed water-collecting pipes. A head control stand is used defining a water-collecting chamber with a float member therein. The latter is operatively connected to a valve disposed in an associated main collector and is opened as a result of the float member being influenced by the measurement of the water table depth between two adjacently disposed water-collecting pipes of the network. The valve remains opened as long as the level of underground water exceeds a value corresponding to optimal plant growth.

8 Claims, 2 Drawing Sheets

CONTROL DEVICE FOR UNDERGROUND DRAINAGE NETWORK

FIELD OF THE INVENTION

The present invention relates to a device for use with an underground drainage network of main collectors and adjacently disposed water-collecting pipes with a view to controlling the water table depth.

BACKGROUND OF THE INVENTION

In order to facilitate access to fields by heavy agricultural machinery during the spring and fall seasons, the ground of these fields is usually drained by an underground system. One widely used method consists in disposing drainage pipes made of plastic or other suitable material in the ground according to specific patterns. These pipes are usually buried at a depth of approximately 0.9 to 2 meters with a tilt angle between 0.01% and 2% and are spaced 10 to 50 meters apart.

When the flow of water in the drainage pipes is not controlled, it varies mainly as a function of the height of water directly above the pipes. Therefore, if the flow is not controlled after a given precipitation, the drainage system will evacuate water in the ground until the level of underground water reaches the level of the drainage pipes.

Many studies have shown that uncontrolled drainage systems cause dehydration of the soil during the crucial growing periods if no sufficient replenishment is provided by precipitations, such as rain. Indeed, since pipes are buried at a level lower than the level of water necessary for optimal plant (or crop) growth and since they drain the soil until the level of water is approximately equal to their level of burial, they are often prejudicial to such growth.

Numerous examples of control systems designed to overcome the above-mentioned problems exist. Some of them are found described in Canadian Patent No. 1,088,330 and U.S. Pat. Nos. 4,621,945, 3,559,408 and 3,368,355. Some most widely used control chambers are shown in U.S. Pat. Nos. 4,621,945 and 3,368,355.

However, these types of control chambers, while limiting the risks of excessive drainage, create a risk of underdrainage. Control chambers are usually adapted to drainage systems and are designed by taking into consideration fixed parameters, such as the hydraulic conductivity of the soil, the drainage coefficient, etc. When added to existing systems, the control chambers, whether of the "overflow" or "float" type, create a virtual drainage depth which is higher than the depth for which the system is designed. This situation leads to the deterioration of crop since the roots tend to rot.

OBJECTS AND STATEMENT OF THE INVENTION

It is an object of the present invention to overcome the above-described problems associated with presently used controlled devices for underground drainage systems. This is achieved by providing a control device for soil drainage by taking into account the level of water between two drainage pipes instead of that directly above the pipes.

It is a further object of the present invention to provide a control device which is readily adaptable to existing drainage systems, which is mechanically simple and which can be manufactured at a relatively low cost.

The present invention therefore relates to a control device which comprises in its broadest aspect: one or more head control stand means disposed at one or more predetermined locations of a network of main collectors and water-collecting pipes; valve means in a main collector associated with each head control stand means; and water table depth-measuring means disposed between two adjacent water-collecting pipes of the network, the measuring means being associated with the stand means to close or open the valve means when the level of water between two adjacent pipes reaches a desired value for optimal crop growth.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

DESCRIPTION OF PREFERRED EMBODIMENTS

Figure 1:
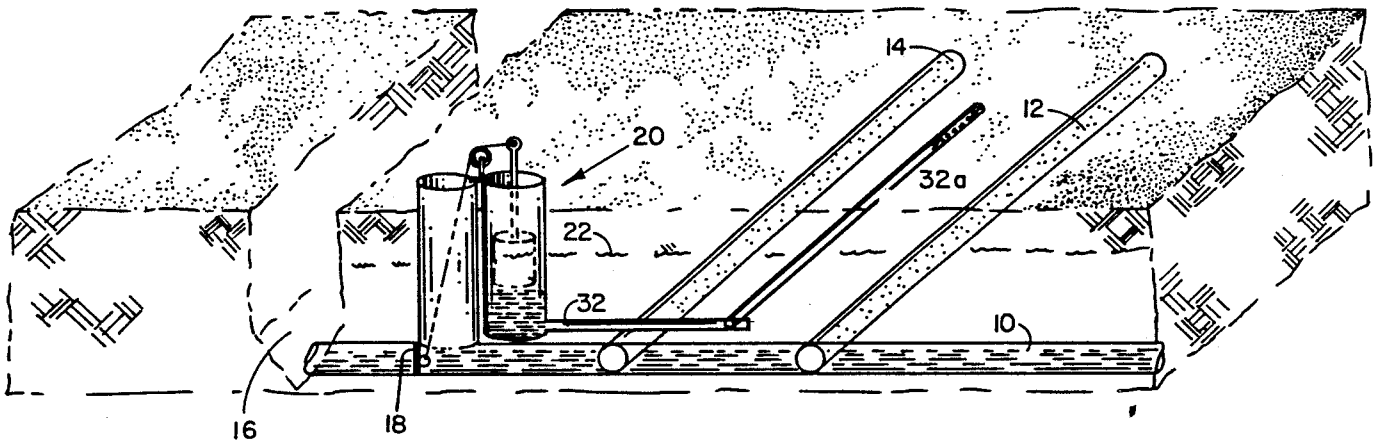
FIG. 1 is a perspective schematic view of an underground drainage network using a control device made in accordance with the present invention.
Figure 2:
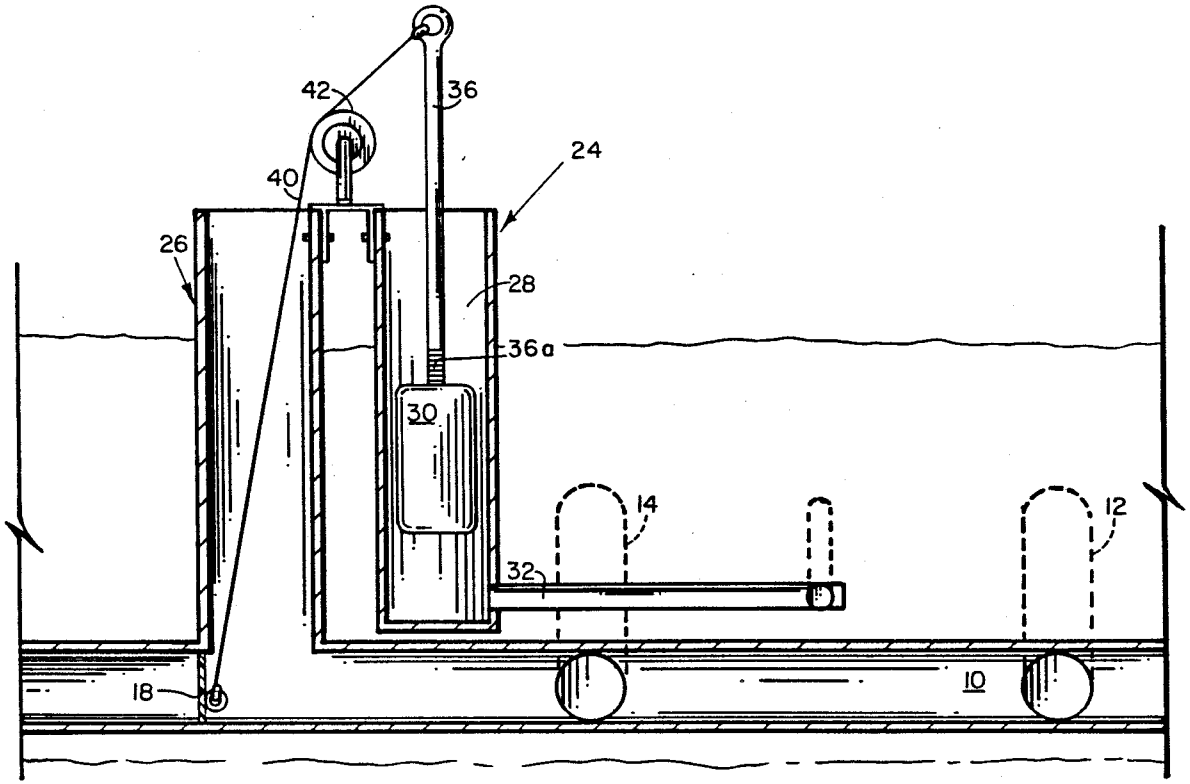
FIG. 2 is an elevational view of one embodiment of the control device.

Referring to FIGS. 1 and 2, there is shown a portion of an underground drainage network that includes a main collector 10 and of two adjacently disposed water-collecting inclined pipes 12 and 14. Water collected in the drainage pipes 12 and 14 are directed to the main collector. A valve in the form of a door 18 is provided in the main collector allowing the water collected to be discharged, when desired, in the ditch 16.

The present invention is concerned with a means 20 for opening or closing the valve 18 to thereby control the water table depth 22 and allow for optimal plant growth. An important feature of the present invention is that this water table depth is measured between the two drainage pipes, preferably at equidistance therefrom.

One form of such means is illustrated in FIG. 2 and comprises a pair of vertically extending head control stands 24 and 26 arranged side-by-side. The head control stand 24 consists of a chamber 28 in which a float member 30 is provided. The lower part of the chamber has an opening to which is connected a duct 32 which is imperforated except in one area 32a situated equidistantly between pipes 12 and 14.

The water collected in the perforated area **32*a* of the duct is conducted through gravity to the chamber 28 causing the float 30 to raise. In the embodiment illustrated, the float is mounted on a shaft 36, the upper extremity of which is operatively associated with the door 18 through a rope 40 and pulley 42**.

The float 30 is adjustably mounted on the shaft 36 so that it may be located at the desired water table depth for optimal plant growth. The shaft is provided with a threaded portion 36a allowing for height adjustment.

When the water collected in the chamber reaches a height causing the float to be actuated, the door 18 is opened until the water table returns to a desired height for optimal plant growth.

Although the invention has been described above in relation to a specific form, it will be evident to the person skilled in the art that it may be refined and modified in various ways. For example, some other water table depth measuring means could be provided instead of the perforated area 32a on the duct 32 to provide some signal to a signal-receiving means in the head stand causing the opening or closing of the valve mechanically, hydraulically or electrically. It is therefore wished to have it understood that the present invention should not be limited in interpretation except by the terms of the following claims.

The embodiments of the invention in which an exclusive property or privilege is claimed are defined as follows:

1. A control device for use with an underground drainage network of main collectors and adjacently disposed water-collecting pipes, comprising:

one or more head control stand means disposed at one or more predetermined locations of said network;

valve means in a main collector associated with each said stand means; and water table depth-measuring means disposed between two adjacent water-collecting pipes of said network; said measuring means being associated with said stand means to open or close said valve means when the level of water between two adjacent pipes reaches a desired value for optimal plant growth.

2. A control device for use with an underground drainage network of main collectors and adjacently disposed water-collecting pipes, comprising:

one or more head control stand means disposed at one or more predetermined locations of said network; each stand means consisting of a vertically extending housing defining a water-receiving chamber; water level sensing means mounted in said chamber;

valve means in a main collector associated with each said stand means, said valve means being actuatable in response to said sensing means; and water table depth-measuring means disposed between two adjacent water-collecting pipes of said network; said measuring means being remotely associated with said water level sensing means in said stand means to open or close said valve means when the level of water between two adjacent pipes reaches a desired value for optimal plant growth.

3. A control device for use with an underground drainage network of main collectors and adjacently disposed water-collecting pipes, comprising:

one or more head control stand means disposed at one or more predetermined locations of said network; each stand means consisting of a vertically extending housing defining a water-receiving chamber; water level sensing means mounted in said chamber;

valve means in a main collector associated with each said stand means, said valve means being operatively connected to said sensing means in said chamber; and water table depth-measuring means in fluid communication with said chamber, said measuring means including water-collecting means having a perforated section disposed between two adjacent water-collecting pipes of said network and an imperforated section connected to said chamber allowing underground water collected in said perforated section to be received in said chamber to thereby influence said water level sensing means into operating said valve means to open or close when the level of water between two adjacent pipes reaches a desired value for optimal plant growth.

4. A control device as defined in claim 3, wherein said stand means include a second housing allowing connection between said sensing means and said valve means.

5. A control device as defined in claim 4, wherein said housings extend vertically in side-by-side parallel relationship.

6. A control device as defined in claim 1, wherein said valve means consists of a door mounted in a main collector associated with said stand means.

7. A control device as defined in claim 3, wherein said sensing means is a float.

8. A control device as defined in claim 7, wherein said float is adjustable in height in said chamber.

* * * * *